US009399833B1

(12) United States Patent
Thornton

(10) Patent No.: US 9,399,833 B1
(45) Date of Patent: Jul. 26, 2016

(54) CLOTHING IRON HAVING A CONTOURING ARCH GRIPPING MEMBER

(71) Applicant: Ira Louis Thornton, Seffner, FL (US)

(72) Inventor: Ira Louis Thornton, Seffner, FL (US)

( * ) Notice: Subject to any disclaimer, the term of this patent is extended or adjusted under 35 U.S.C. 154(b) by 0 days.

(21) Appl. No.: 14/877,878

(22) Filed: Oct. 7, 2015

(51) Int. Cl.

| | |
|---|---|
| ***D06F 71/34*** | (2006.01) |
| ***D06F 75/38*** | (2006.01) |
| ***D06F 71/36*** | (2006.01) |
| ***D06F 75/28*** | (2006.01) |
| ***D06F 71/02*** | (2006.01) |

(52) U.S. Cl.
CPC ..... *D06F 71/026* (2013.01); *D06F 71/34* (2013.01); *D06F 71/36* (2013.01); *D06F 75/28* (2013.01); *D06F 75/38* (2013.01)

(58) Field of Classification Search
CPC ..... D06F 71/34; D06F 71/36; D06F 71/18; D06F 71/38; D06F 73/00; D06F 71/026; D06F 75/28; D06F 75/38; A47G 25/72; A47G 75/30; A47G 75/38; A47G 75/34; H05B 1/00; H05B 3/00; H05B 1/0255
See application file for complete search history.

(56) References Cited

U.S. PATENT DOCUMENTS

| | | | | |
|---|---|---|---|---|
| 2,441,817 | A * | 5/1948 | Huff | B25B 7/20 156/579 |
| 3,752,017 | A * | 8/1973 | Lloyd | B23K 3/0307 219/221 |
| 5,951,894 | A * | 9/1999 | White, Jr. | A45D 1/04 219/222 |
| 7,188,442 | B2 * | 3/2007 | Fernandez | D06F 75/14 38/81 |
| 8,035,061 | B2 * | 10/2011 | Jung | A45D 1/04 132/223 |
| 8,276,297 | B2 * | 10/2012 | Fabrikant | D06F 71/32 38/15 |
| 8,863,414 | B2 * | 10/2014 | Mohamad | D06F 71/14 38/16 |
| 8,967,159 | B1 * | 3/2015 | Jenkins | A45D 2/001 132/223 |
| 2008/0216860 | A1 * | 9/2008 | Legrain | A45D 1/04 132/224 |
| 2011/0271564 | A1 * | 11/2011 | Artinian | D06F 75/10 38/69 |
| 2012/0102793 | A1 * | 5/2012 | Harrington | D06F 71/32 38/93 |
| 2012/0266502 | A1 * | 10/2012 | Noto | D06F 71/34 38/77.1 |

FOREIGN PATENT DOCUMENTS

GB 2512953 A * 10/2014

* cited by examiner

*Primary Examiner* — Ismael Izaguirre
(74) *Attorney, Agent, or Firm* — Inventions International Inc.; Tiffany C. Miller

(57) ABSTRACT

A clothing iron configured to operate from a motor vehicle power supply having a port to electrically connect to a removable DC cable with a cigarette lighter plug. The clothing iron has an improved arched hand grip having a primary gripping member with a contouring arch extending from a first end of the primary gripping member to a second end of the primary gripping member, a secondary gripping member with a contouring arch extending from a first end of the secondary gripping member to a second end of the secondary gripping member. The gripping members are pivotally connected to a fulcrum point. A primary housing is connected to an end of the primary gripping member. At least one thermally conductive plate is connected to the primary housing. A secondary housing is connected to an end of the secondary gripping member. A capturing structure is connected to the secondary housing.

20 Claims, 8 Drawing Sheets

1
12B
12A
11B
38
11A
39
41
40
4
6
33
34
8A
8B
37
2
3
35
36
31
19
30
7
5
32
15

CLOTHING IRON HAVING A CONTOURING ARCH GRIPPING MEMBER

BACKGROUND OF THE INVENTION

1. Field of the Invention

This invention relates, generally, to a clothing iron. More particularly, it relates to a clothing iron configured to operate from a motor vehicle power supply.

2. Background Art

Currently, a user including, but not limited to, an individual, a business professional, an employee, or a student may commute to a location while being secured into a vehicle seat with a seat belt harness. A seat belt harness is configured to secure a user's torso within a vehicle seat and overlays a garment that is covering a user's torso. A garment includes, but is not limited to, a shirt, a blouse, a blazer, a vest, a tie, a scarf, or a jacket. Upon removal of the seat belt harness, many of these individuals may experience a crease in their garment from the seat belt harness. At this point, a user is at their desired destination and as a result of being secured by a seat belt harness their garment may have a wrinkle or a crease in it. It would be inconvenient and impractical for a user to have to carry around a bulky clothing iron and a large ironing board to remove a crease in their garment caused by a seat belt harness. Thus, there is a need for a DC powered clothing iron in which a user can operate from inside of their vehicle and can operate without the need for a garment to be laid flat on an ironing board during the ironing process.

Many clothing irons on the market today have a single, flat surface that becomes heated during use. This heated surface is configured to iron or press a garment on an ironing board to remove a crease. This clothing iron requires the garment to be positioned flat on an ironing board during the ironing process and also requires an AC power source. Thus, there is a need for an improved heating surface for a clothing iron, thereby, eliminating the need for a user to remove the garment from a user's body during the ironing process and eliminating the need for a garment to be laid flat on an ironing board during the ironing process.

Conventional clothing irons further include a single handle configured for a user to grip and to apply a force to a garment positioned upon a flat surface of an ironing board. There is a need for an improved arched handle structure configured for a user to operate the clothing iron while the user is wearing a garment, thereby, eliminating the need for the time consuming removal of the garment from a user's body and eliminating the need for a bulky ironing board.

However, in view of the prior art considered as a whole at the time the present invention was made, it was not obvious to those of ordinary skill in the pertinent art how the identified needs could be fulfilled.

SUMMARY OF THE INVENTION

The long-standing but heretofore unfulfilled need for a clothing iron being configured to operate from a motor vehicle power supply having a port to electrically connect to a removable DC cable with a cigarette lighter plug. The clothing iron has an improved arched hand grip having a primary gripping member with a contouring arch extending from a first end of the primary gripping member to a second end of the primary gripping member, a secondary gripping member with a contouring arch extending from a first end of the secondary gripping member to a second end of the secondary gripping member. A primary housing is connected to the primary gripping member. At least one thermally conductive plate is connected to the primary housing. A secondary housing is connected to the secondary gripping member. A capturing structure is connected to the secondary housing. The gripping members are pivotally connected to a fulcrum point. The force of a user's grip upon the gripping members is configured to orient the clothing iron from an open orientation to a closed orientation. The clothing iron can have an auto shut-off mechanism, a compartment configured to retain a liquid, a release button configured to release a liquid from the compartment onto a garment, a removable adapter in electrical connection to the clothing iron port for AC power, and a heat plate barrier guard connected thereto which also includes improvements that overcome the limitations of prior art clothing irons is now met by a new, useful, and non-obvious invention.

The novel clothing iron has at least one thermally conductive plate having a contact surface configured to contact a primary side of a garment. At least one thermally conductive plate is located opposite a capturing structure having a capturing surface, whereby, the capturing surface is configured to contact a secondary side of a garment.

A primary gripping member is located opposite a secondary gripping member. The primary gripping member has a contouring arch extending from a first end of the primary gripping member to a second end of the primary gripping member. The contouring arch of the primary gripping member has a gripping surface located opposite a compartment wall surface. The first end of the primary gripping member is connected to a primary housing. At least one thermally conductive plate is connected to the primary housing. The primary housing borders an outer perimeter of the at least on thermally conductive housing. The at least one thermally conductive plate protrudes from the primary housing.

At least one barrier element is connected to an outer perimeter edge of the primary housing. The at least one barrier element is located adjacent to a portion of the thermally conductive plate. The at least one barrier element protrudes from the primary housing.

In a preferred embodiment, the second end of the primary gripping member is pivotally connected to a fulcrum point.

A secondary gripping member has a contouring arch extending from a first end of the secondary gripping member to the second end of the secondary gripping member. The contouring arch of the secondary gripping member has a gripping surface located opposite a compartment wall surface. The first end of the secondary gripping member is connected to a secondary housing. A capturing structure is connected to the secondary housing. The secondary housing borders an outer perimeter of the capturing structure. A portion of the capturing structure protrudes from the secondary housing.

The second end of the secondary gripping member is pivotally connected to a fulcrum point.

In a second embodiment, at least one barrier element is connected to an outer edge of the primary housing. The at least one barrier element is located adjacent to a portion of the capturing structure. The at least one barrier element protrudes from the secondary housing.

The gripping surface of both the primary gripping member and the secondary gripping member are configured to contour to the grasp of a user's hand. The clothing iron is adapted for the force of a user's grasp to orient the primary gripping member and the secondary gripping member from an open orientation to a closed orientation. A portion of the garment is configured to be captured between at least one thermally conductive plate and the capturing structure.

In an alternate embodiment, the novel clothing iron's capturing structure is a thermally conductive plate. This capturing structure can have a heating element electrically connected thereto to enable the capturing structure to become heated. It is within the scope of this invention for the capturing structure to not be heated by a heating element electrically connected thereto. It is envisioned that the capturing structure could have a substantially flat or curved surface to connect with a portion of a garment as the garment is being heated up from the heat generated by the thermally conductive plate.

In another alternate embodiment, at least one thermally conductive plate is in electrical connection with at least one heating element. At least one heating element is configured to operate on DC voltage supplied by said motor vehicle. It is also within the scope of this invention for at least one heating element to be configured to operate on AC voltage power source.

In yet another embodiment, the contouring arch of the primary gripping member has at least one dedicated finger recess configured to receive at least one finger of a user. It is within the scope of this invention for the secondary gripping member to have at least one dedicated finger recess configured to receive at least one finger of a user.

In another embodiment, the contouring arch of the secondary gripping member has at least one dedicated thumb recess configured to receive a thumb of a user. It is within the scope of this invention for the primary gripping member to have a dedicated thumb recess configured to receive a thumb of a user.

In an alternate embodiment, the secondary housing has at least one barrier element connected to an outer perimeter edge of the secondary housing. At least one barrier element is located adjacent to a portion of the capturing structure, whereby, the at least one barrier element protrudes from the secondary housing.

In another embodiment, at least one thermally conductive plate has at least one opening.

In another embodiment, the clothing iron can have a spray assembly having at least one gripping member with a compartment configured to receive a liquid through a compartment primary opening. The compartment primary opening can have a removable cover. The compartment retains the liquid. The liquid can be released directly from the compartment onto a garment or the water can be heated through the thermally conductive plate and can be released as steam applied to a garment. It is within the scope of this invention for the liquid to be water, a solution to aide in the crease or wrinkle removal, vinegar, or a chemical. The compartment has a compartment secondary opening connected to tubing. The tubing has a first end connected to the compartment secondary opening and a second end connected to an opening of the thermally conductive plate. A release mechanism including, but not limited to, a button, a lever, or a switch is located on at least one gripping member. The release member is configured to be depressed by a user to release the liquid from the compartment.

In yet another embodiment, the novel clothing iron has an auto shut-off mechanism. After the clothing iron has become heated, the clothing iron will turn off after a predetermined time period determined by a programmer. It is within the scope of this invention for a programmer to include, but not be limited to, a user or a manufacturer.

In another alternate embodiment, the clothing iron has a port in electrical connection with a removable cigarette lighter plug. The port can be in electrical connection with a removable adapter configured to electrically connect to an AC power source.

It is therefore an important object of the present invention to provide a clothing iron being configured to operate from a motor vehicle power supply having a port to electrically connect to a removable DC cable with a cigarette lighter plug.

BRIEF DESCRIPTION OF THE DRAWINGS

For a fuller understanding of the nature and objects of the invention, reference should be made to the following detailed description, taken in connection with the accompanying drawings, in which.

DETAILED DESCRIPTION OF THE PREFERRED EMBODIMENT

Figure 1:
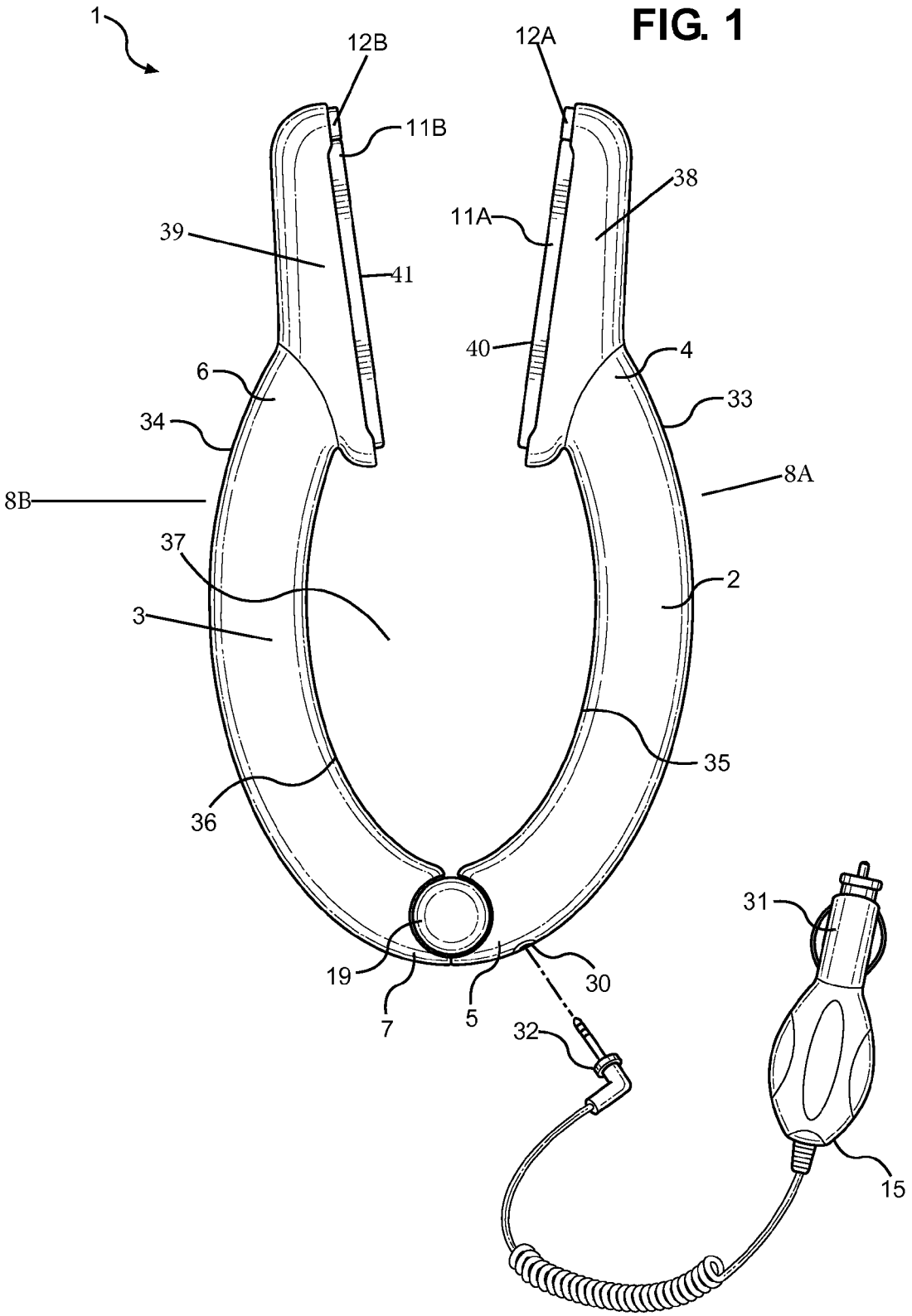
FIG. 1 is a side perspective view of the novel clothing iron in an open configuration with a removable cigarette lighter plug.

In the following detailed description of the preferred embodiments, reference is made to the accompanying drawings, which form a part hereof, and within which are shown by way of illustration specific embodiments by which the invention may be practiced. It is to be understood that other embodiments may be utilized and structural changes may be made without departing from the scope of the invention.

In a general embodiment, novel clothing iron 1 is configured to operate from a motor vehicle power supply (not shown). A motor vehicle (not shown) includes, but is not limited to, a car, a truck, a van, a boat, or an aircraft. Thermally conductive plate 11A has a contact surface configured to contact primary side 28 (FIG. 4) of garment 14. It is within the scope of this invention for a garment to include, but not be limited to, a shirt, a blouse, a jacket, a tie, a vest, pants, a scarf, or a coat. Thermally conductive plate 11A is located opposite capturing structure 11B. Capturing structure 11B is configured to contact secondary side 29 (FIG. 4) of garment 14. Capturing structure 11B includes, but is not limited to, a thermally conductive plate capable of being heated with heating element 20, a surface not capable of being heated with a heating element, or a non-conductive surface.

Figure 5:
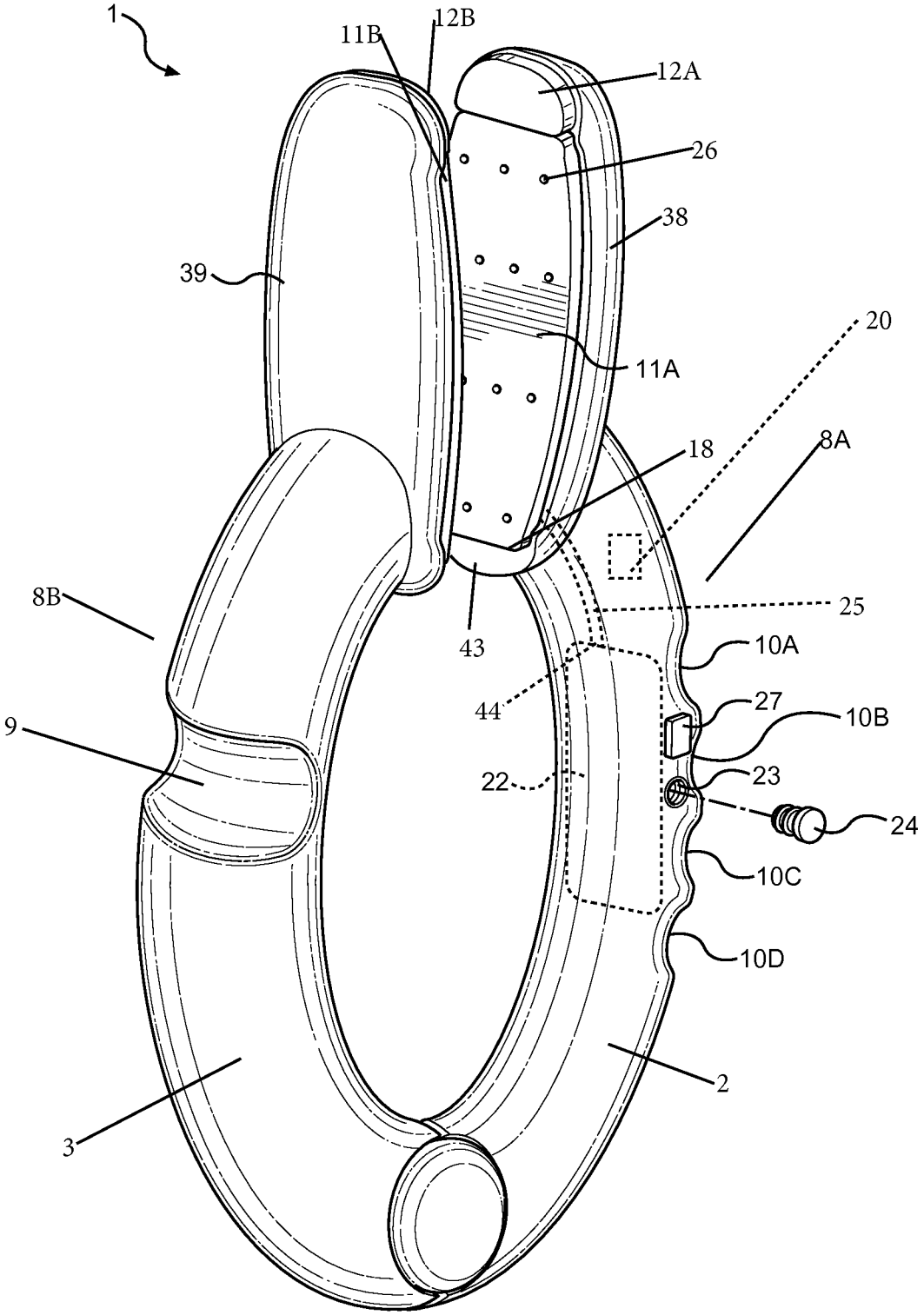
FIG. 5 is an alternate perspective view of the gripping member thumb recess, the gripping member finger recesses, the spray assembly including the inter-relation of the liquid compartment and compartment cover, the release mechanism, the tubing, and the openings in the thermally conductive plate.

It is within the scope of this invention for at least one thermally conductive plate 11A to be in electrical connection with heating element 20 (FIG. 5). The electrical connection includes, but is not limited to an electrically conductive wire or cable. The heating element 20 is configured to heat at least one thermally conductive plate. A portion of garment 14 is configured to be captured between thermally conductive plate 11A and capturing structure 11B.

It is a preferred embodiment for thermally conductive plate 11A and capturing structure 11B to have a substantially flat surface (FIGS. 1-9). It is within the scope of this invention for at least one of thermally conductive plate 11A and capturing structure 11B to have a substantially curved surface (not shown).

Primary gripping member 2 is located opposite secondary gripping member 3. Primary gripping member 2 has a substantial arch from primary end 4 to secondary end 5 of primary gripping member 2. Secondary gripping member 3 has a substantial arch from primary end 6 to secondary end 7 of secondary gripping member 3. Primary gripping member 2 is connected to primary housing 38. Thermally conductive plate 11A is connected to primary housing 38. Secondary gripping member 3 is connected to secondary housing 39. Capturing structure 11B is connected to secondary housing 39. A gripping member can have at least one thermally conductive plate 11A and/or capturing surface 11B connected thereto. In an alternate embodiment a gripping member can have a plurality of thermally conductive plates or a plurality of capturing surfaces connected thereto (not shown).

In a preferred embodiment, clothing iron 1 has garment compartment 37 having primary arched compartment wall 35 located opposite secondary arched compartment wall 36. Primary gripping member 2 has primary arched gripping surface 33 configured to contour to the grip of a user's hand located opposite primary arched compartment wall 35. Secondary gripping member 3 has secondary arched gripping surface 34 configured to contour to the grip of a user's hand located opposite secondary arched compartment wall 36. A portion of garment 14 is configured to be received by compartment 37 when a contact surface of thermally conductive plate 11A contacts primary side 28 of garment 14 and a capturing surface of capturing structure 11B contacts secondary side 29 of garment 14. A portion of garment 14 is configured to be retained in compartment 37, whereby, a portion of garment 14 may contact at least one of a surface of primary compartment wall 35 and secondary compartment wall 36.

Thermally conductive plate 11A can have barrier element 12A bordering the outer perimeter 18 of thermally conductive plate 11A. Capturing structure 11B can have barrier element 12B bordering the outer perimeter 21 of capturing structure 11B. This barrier element acts as a barrier between a heated plate and another surface including, but not limited to, a vehicle seat, a dashboard, a user, or a center console. A portion of barrier element 12A and/or 12B protrudes from the outer perimeter of thermally conductive plate 11A and/or capturing surface 11B. When a user places heated clothing iron 1 on a surface when not in use, barrier element 12A and 12B (FIGS. 1 and 2) prevents the surface that heated clothing iron 1 is in contact with from becoming damaged from the heated plates.

Fulcrum point 19 can be part of or formed within a portion of a gripping member. Fulcrum point 19 can be connected to a portion of a gripping member. Fulcrum point 19 is configured to pivot at least one gripping member of clothing iron 1 from an open configuration (FIG. 1) to a closed configuration (FIG. 2), whereby, a portion of a user's garment 14 is captured between at least one thermally conductive plate 11A and capturing structure 11B.

Figure 6:
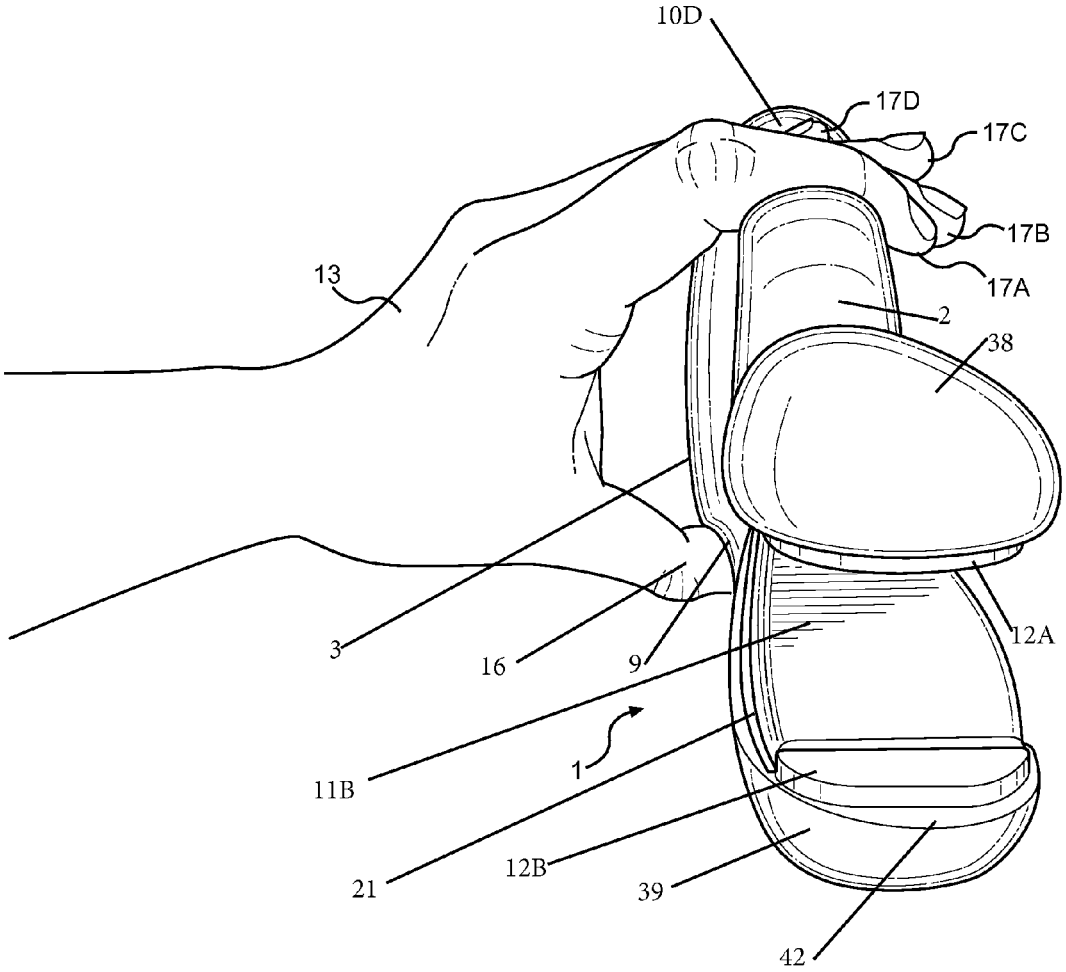
FIG. 6 is a top perspective view of the primary barrier element and the secondary barrier element, the capturing surface, and a user's fingers engaging the finger recesses of a gripping member and a user's thumb engaging the thumb recess of another gripping member.

In an alternate embodiment, at least one gripping member has a contouring arch. The contouring arch is configured to contour to a user's hand grip. The contouring arch is radiused to conform to the shape of a user's palm and fingers as a user is gripping a gripping member of clothing iron 1. In an alternate embodiment, the contouring arch has at least one dedicated finger recess 10A configured to receive a portion of a user's finger 17A. Dedicated finger recess 10A secures a portion of a user's finger 17A to improve a user's grip of the gripping member. It is within the scope of this current invention for the contouring arch to have a plurality of dedicated finger recesses 10A, 10B, 10C, and 10D. Each dedicated finger recess is configured to secure at least one finger 17A-17D (FIGS. 6 and 7).

Figure 7:
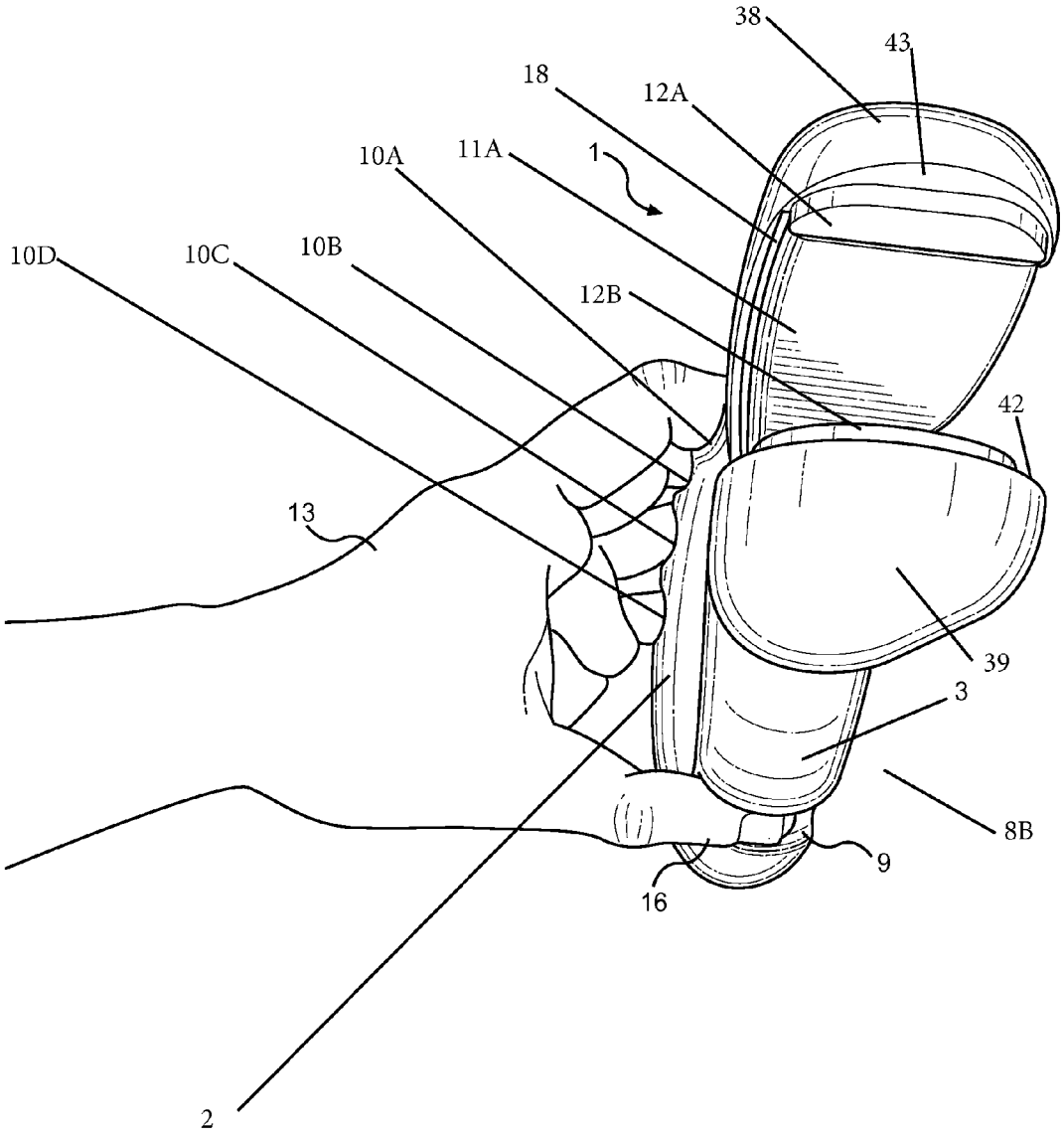
FIG. 7 is a rear perspective view of the primary barrier element and the secondary barrier element, the capturing surface, and a user's fingers engaging the finger recesses of a gripping member and a user's thumb engaging the thumb recess of another gripping member.
Figure 8:
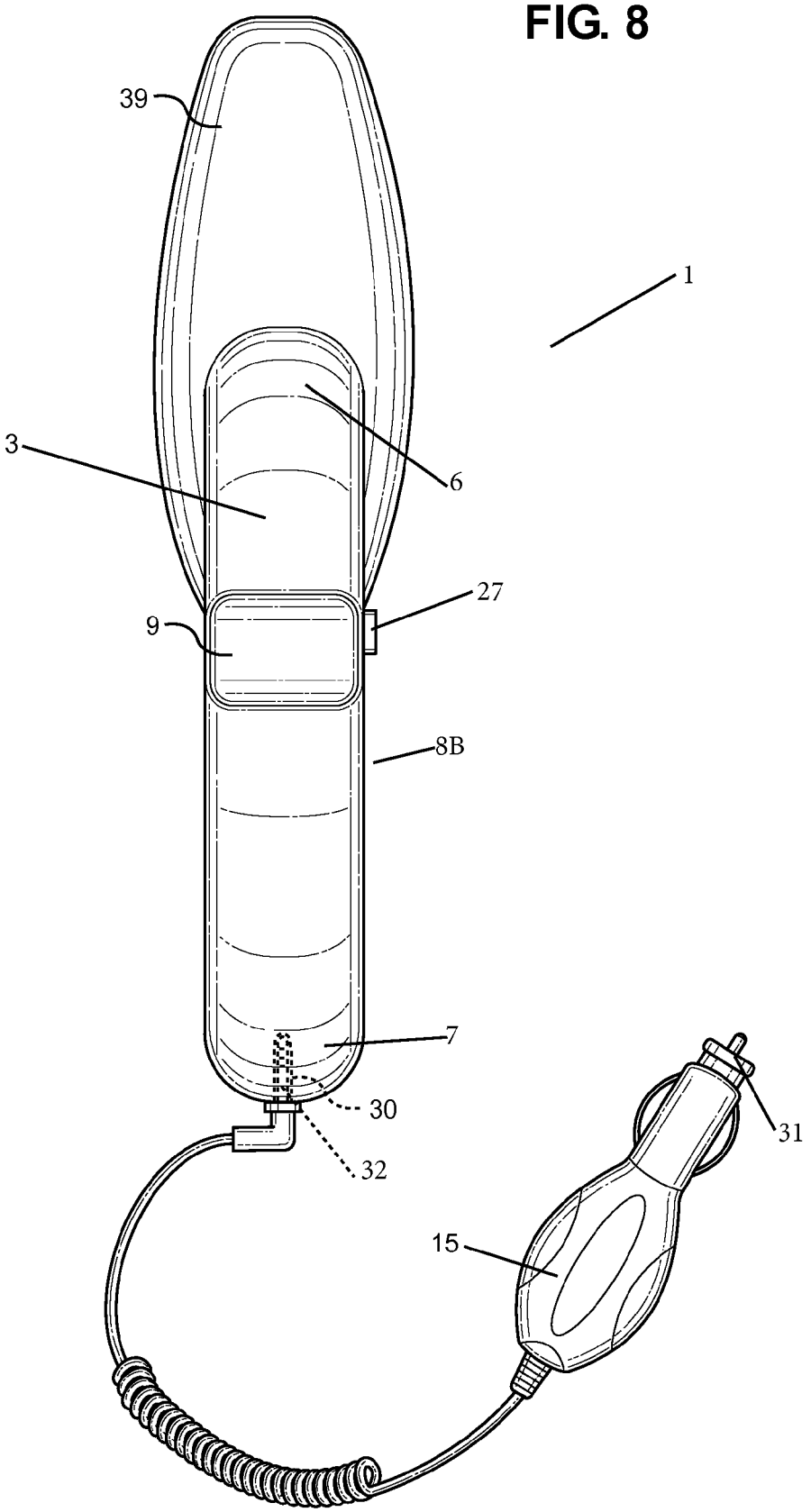
FIG. 8 is a rear perspective view of the contouring arch and the dedicated thumb recess; and, FIG. 9 is a front perspective view of the contouring arch and dedicated finger recesses.
Figure 9:
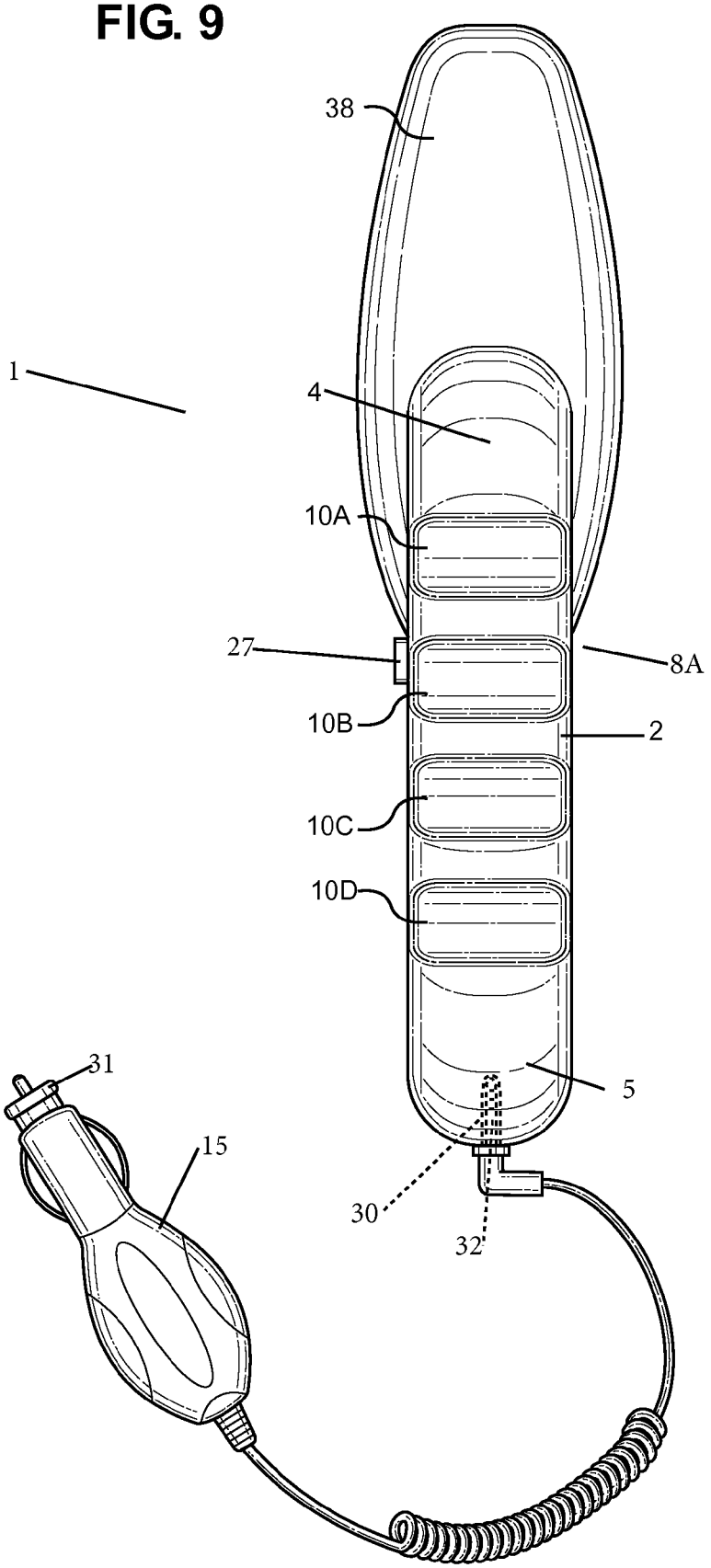

In an alternate embodiment, at least one gripping member can have dedicated thumb recess 9 configured to secure a portion of user's thumb 16 (FIG. 7). Dedicated thumb recess 9 facilitates a more secure grip while operating clothing iron 1.

Both the dedicated finger recesses 10A-10D and the dedicated thumb recess 9 help user's hand 13 maintain a strong and stable grip of clothing iron 1 while operating clothing iron 1. More particularly, this additional grip support prevents clothing iron 1 from slipping from a user's hand 13 when clothing iron 1 is ironing garment 14 that is being worn by a user. For example, if a user is seated in a car seat and wants to iron the lower edge of a shirt that they are wearing, clothing iron 1 can be positioned in a substantially vertical orientation in relation to a user's torso as the shirt during operation of clothing iron 1.

In a preferred embodiment, clothing iron 1 has a cigarette lighter plug 15 (FIG. 1) removably connected thereto. Cigarette lighter plug 15 has primary end 31 configured to connect to a DC power source including, but not limited to, a cigarette lighter receptacle. Cigarette lighter plug 15 has secondary end 32 configured to have an electrical connection with port 30 (FIG. 1) of clothing iron 1. It is within the scope of the current invention for clothing iron 1 to be connected to cigarette lighter plug to heat at least one thermally conductive plate. It is also within the scope of this invention for a removable adapter (not shown) to be connected to port 30. The removable adapter is configured to electrically connect to an AC power source.

Thermally conductive plate 11A is a metal capable of retaining heat including, but not limited to, steel, stainless steel, or cast iron. Secondary end 32 of cigarette lighter plug 15 is configured to be removable from port 30. Once thermally conductive plate 11A is heated with at least one heating element 20, secondary end 32 of cigarette lighter plug 15 can be removed from port 30 of clothing iron 1. Thermally conductive plate 11A (FIG. 1) is configured to retain heat when the secondary end 32 of cigarette lighter plug 15 is removed from port 30, whereby, a user can operate the clothing iron 1 to press out a crease of garment 14 without having an electrically conductive element including, but not limited to, a wire or a cord, connected to iron 1.

In an alternate embodiment, at least one gripping member has limit structure (not shown) connected thereto. The limit structure is configured to limit the open configuration distance of clothing iron 1 between at least one thermally conductive plate 11A and capturing structure 11B.

In an alternate embodiment, at least one gripping member has compartment 22 having primary compartment opening 23. A liquid (not shown) including, but not limited to, water, a chemical, a cleaning solution, a wrinkle guard, or a solution is stored in compartment 22. Compartment 22 is configured to retain a liquid and has removable compartment cover 24 removably connected to primary compartment opening 23. Removable compartment cover 24 includes, but is not limited to, a plug (FIG. 5) or a hingedly foldable cover (not shown). Removable compartment cover 24 creates a liquid-tight seal to prevent the liquid from leaking out of primary compartment opening 23. Removable compartment cover 24 can have a sealing structure with protruding stepped portions (FIG. 5).

The liquid (not shown) is configured to be released from clothing iron 1 and to be sprayed upon a portion of garment 14. The liquid is configured to be released from clothing iron 1 as liquid or as steam when a user depresses release mechanism 27 (FIG. 5). It is within the scope of this current invention for the liquid to be released from a portion of at least one gripping member. In another embodiment, at least one thermally conductive plate 11A can have at least one opening 26 (FIG. 5) configured for the liquid to be heated while passing through the heated plate and to be released onto a garment 14. In yet another embodiment, a capturing structure can have at least one opening configured for the liquid to be released (not shown). In another embodiment, at least one thermally conductive plate 11A can have a plurality of openings 26 (FIG. 5).

The spray assembly is integrally formed within at least one of the gripping members. Tubing 25 has an end connected to secondary compartment opening 44 and has another end connected to opening 26 of thermally conductive plate 11A. A stored liquid within compartment 22 can pass through tubing 25 and be released through at least one opening 26 when a user depresses release mechanism 27 (FIG. 5). The liquid is configured to contact a portion of garment 14 and aids in the release of wrinkles and creases in garment 14.

In an alternate embodiment, the novel clothing iron port can be in electrical connection with a universal DC power adapter having a cigarette lighter plug connected thereto. The novel clothing iron port can be in electrical connection with an AC adapter configured to support at least one plug system.

Construction of the Novel Clothing Iron

It will now be seen, referring to FIGS. 1-4 clothing iron 1 has primary gripping member 2 located opposite secondary gripping member 3. Primary gripping member 2 has primary end 4 located opposite secondary end 5. Secondary gripping member 3 has primary end 6 located opposite secondary end 7. Fulcrum 19 is configured to support both primary gripping member 2 and secondary gripping member 3. Primary gripping member 2 has contouring arch 8A. Secondary gripping member 3 has contouring arch 8B.

Figure 2:
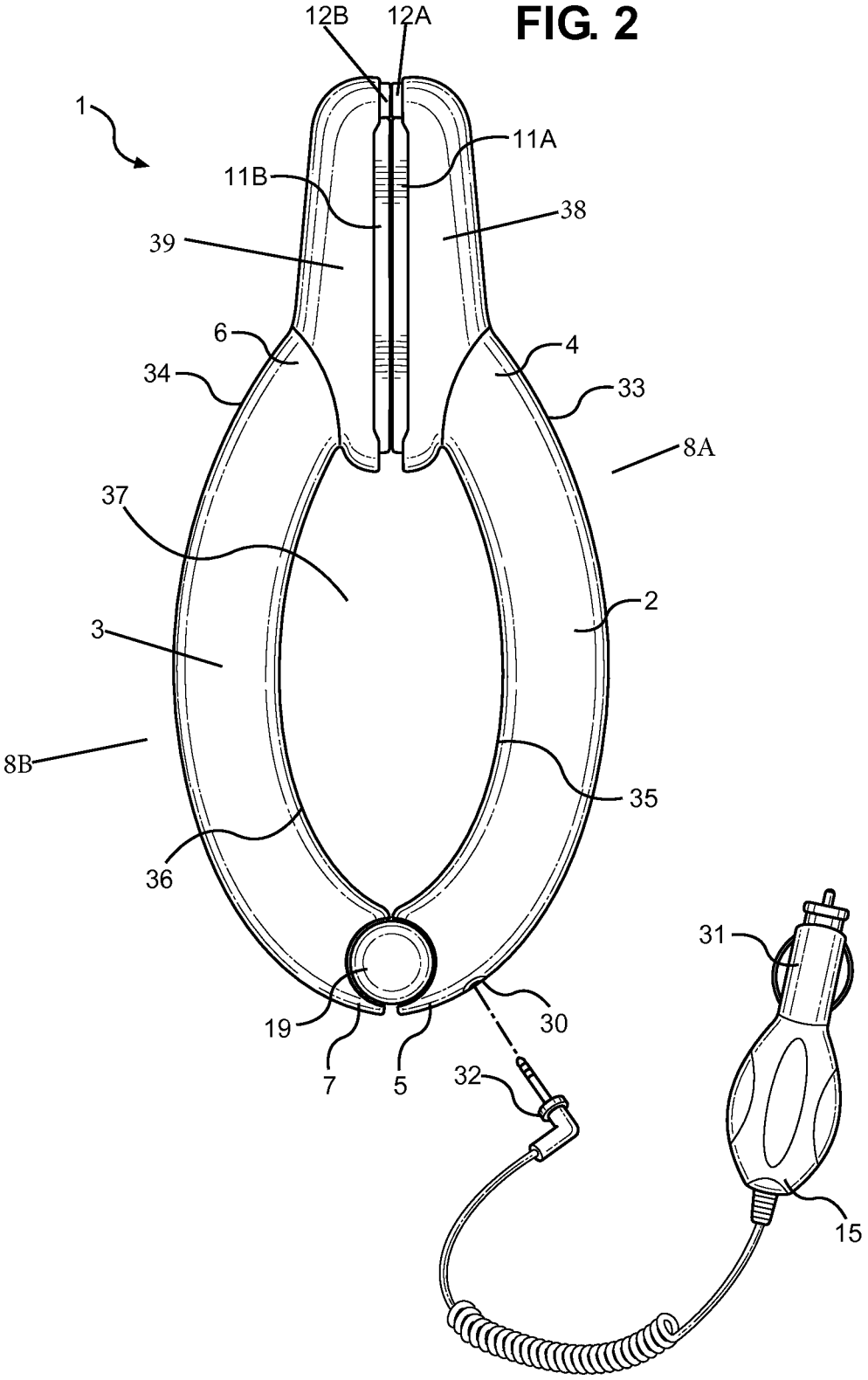
FIG. 2 is a side perspective view of the novel clothing iron in a closed configuration with a removable cigarette lighter plug.
Figure 3:
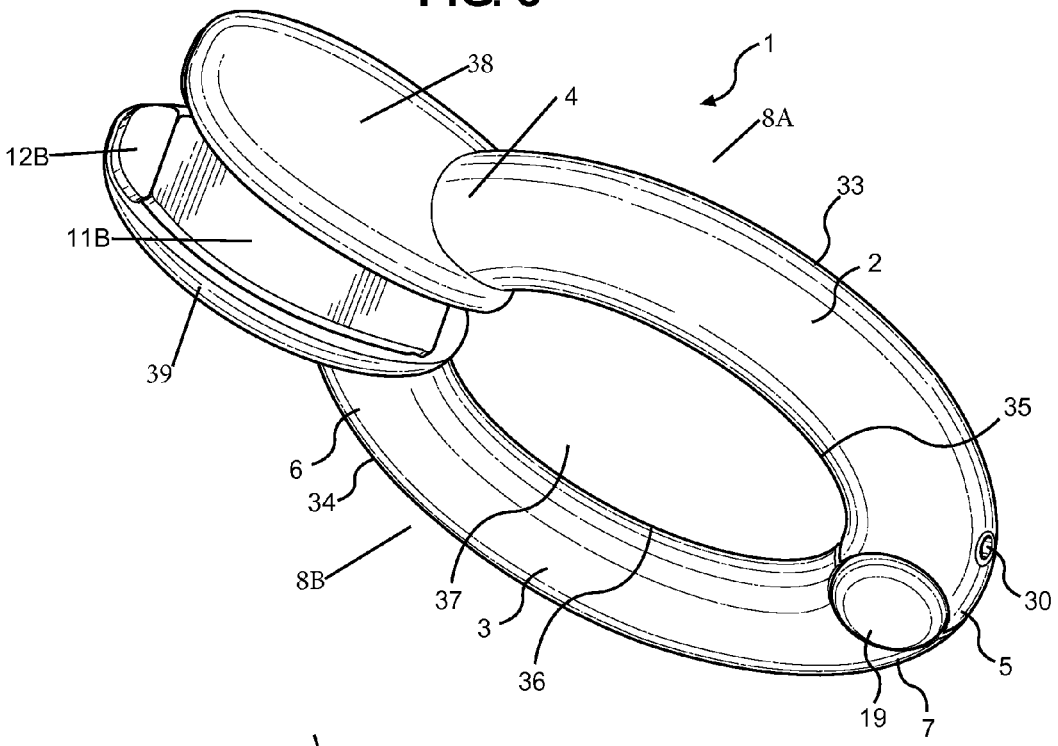
FIG. 3 is a perspective view of the novel clothing iron having a fulcrum point and a port.

FIGS. 1-4 best illustrate primary gripping member 2 having primary gripping surface 33 located opposite primary arched compartment wall 35 (FIGS. 1-3). Secondary gripping member 3 has secondary gripping surface 34 located opposite secondary arched compartment wall 36 (FIGS. 1-3). Primary arched compartment wall 35 and secondary arched compartment wall 36 form compartment 37.

Figure 4:
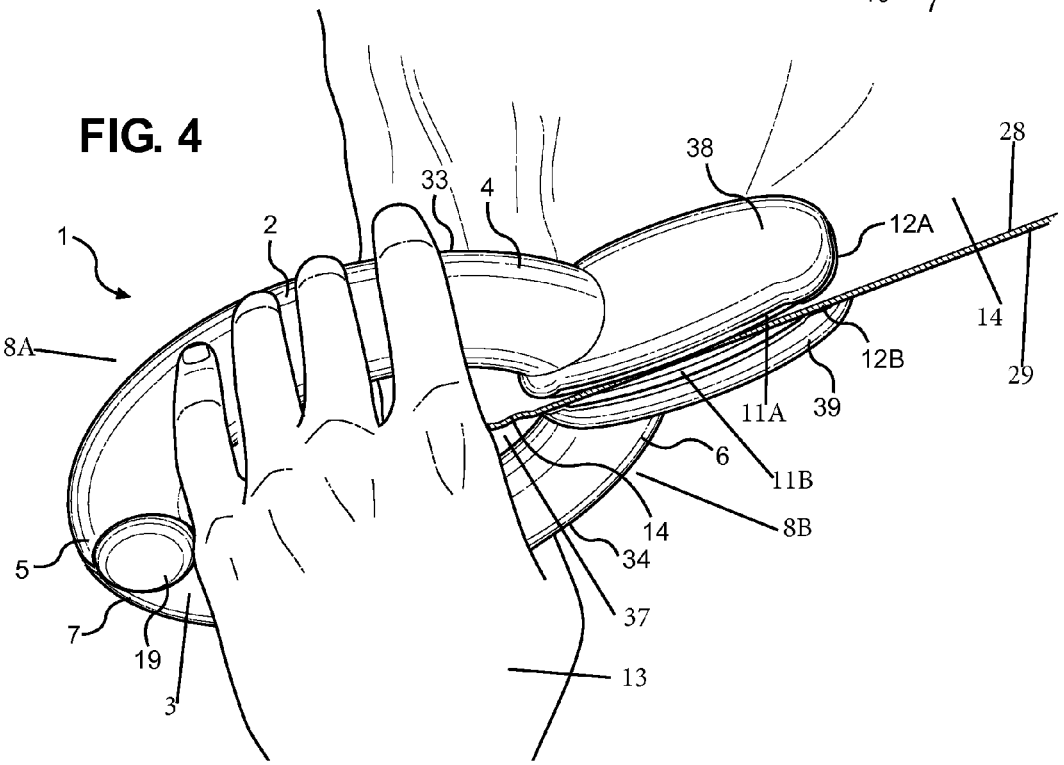
FIG. 4 is a perspective view of the novel clothing iron having a gripping member being gripped by a user's hand, both the thermally conductive plate and the capturing surface contact a user's garment.

As best depicted in FIG. 4, Primary arched compartment wall 35 and secondary arched compartment wall 36 form compartment 37 configured to receive the excess portion of garment 14 that is being ironed. Garment 14 has primary side 28 located opposite secondary side 29. Gripping members 2 and 3 are adapted for user's hand 13 to grasp and to apply a force to the gripping members to orient the clothing iron to a closed configuration, whereby, a portion of garment 14 is captured between thermally conductive plate 11A and capturing structure 11B.

Referring to FIGS. 1-4, primary housing 38 is connected to primary end 4 of primary gripping member 2. Thermally conductive plate 11A having contact surface 40 (FIG. 1) is connected to primary housing 38. First end 6 of secondary gripping member 3 is connected to secondary housing 39. Capturing structure 11B having capturing surface 41 is connected to secondary housing 39. Primary barrier element 12A is connected to primary housing 38. Secondary barrier element 12B is connected to secondary housing 39.

FIGS. 1, 2, 8, and 9 illustrate at least one gripping member having port 30 configured to electrically connect with removable DC cable with cigarette lighter plug 15. DC cable with cigarette lighter plug 15 has primary end 31 configured to connect to a DC power source. DC cable with cigarette lighter plug 15 has secondary end 32 connected to port 30.

FIGS. 5 and 7 depict primary barrier element 12A being located adjacent to an outer perimeter 18 of thermally conductive plate 11A. Primary barrier element 12A is connected to an outer perimeter edge 43 of primary housing 38. FIGS. 6 and 7 best shows secondary housing 39 having a secondary barrier element 12B connected to an outer perimeter edge 42 of the secondary housing 39.

FIGS. 5 and 6 best show secondary barrier 12B and capturing structure 11B are connected to secondary housing 39. Secondary barrier 12B is located adjacent to the outer perimeter edge 21 (FIG. 6) of capturing structure 11B. Primary barrier 12A and second barrier 12B both provide a barrier to protect against damaging a contact surface that is not in direct alignment with at least one thermally conductive plate including, but not limited to, when a user sets clothing iron 1 down on a car seat, a center console, or a dashboard.

FIG. 5 illustrates at least one gripping member having at least one heating element 20. Heating element 20 is electrically connected to at least one thermally conductive plate 11A and is electrically connected to port 30. At least one gripping member 2 and 3 of clothing iron 1 has an integrally formed compartment 2 having primary compartment opening 23 and secondary compartment opening 44. Primary compartment opening 23 is configured to receive a liquid. Compartment cover 24 can be inserted into compartment opening 23 to create a water-tight seal to prevent the liquid from leaking out of primary compartment opening 23. Secondary compartment opening 44 of compartment 22 is connected to an end of tubing 25. Tubing 25 has another end connected to at least one opening 26 of thermally conductive plate 11A. Release mechanism 27 is located on at least one gripping member and is depressed by a user to release liquid (not shown) from compartment 22 through tubing 25 and out of opening 26 of thermally conductive plate 11A.

FIGS. 5-9 show an alternate embodiment of primary gripping member 2 having contouring arch 8A having primary dedicated finger recess 10A configured to receive user's primary finger 17A, secondary dedicated finger recess 10B configured to receive user's secondary finger 17B, tertiary dedicated finger recess 10C configured to receive user's tertiary finger 17C, and quaternary dedicated finger recess 10D configured to receive user's quaternary finger 17D. Secondary gripping member 3 having contouring arch 8B has dedicated thumb recess 9 configured to receive user's thumb 16.

It will thus be seen that the objects set forth above, and those made apparent from the foregoing description, are efficiently attained. Since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention that, as a matter of language, might be said to fall therebetween.

Now that the invention has been described,

The invention claimed is:

1. A clothing iron configured to operate from a motor vehicle power supply, comprising:

at least one thermally conductive plate having a contact surface configured to contact a first side of a garment, said at least one thermally conductive plate is located opposite a capturing structure, whereby, said capturing structure is configured to contact a second side of said garment;

a first gripping member is located opposite a second gripping member, said first gripping member comprising a contouring arch extending from a first end of said first gripping member to a second end of said first gripping member, said contouring arch of said first gripping member having a first gripping surface located opposite a compartment wall surface, said first end of said first gripping member is connected to a first housing, said at least one thermally conductive plate is connected to said first housing, whereby, said first housing borders an outer perimeter of said at least one thermally conductive housing, whereby, said contact surface of said at least one thermally conductive plate protrudes from said first housing;

at least one barrier element is connected to an outer perimeter edge of said first housing, said at least one barrier element is located adjacent to a portion of said thermally conductive plate, whereby, said at least one barrier element protrudes from said first housing;

said second end of said first gripping member is pivotally connected to a fulcrum point, whereby, said first gripping member is located between said at least one thermally conductive plate and said fulcrum point;

said second gripping member comprising a contouring arch extending from a first end of said second gripping member to said second end of said second gripping member, said contouring arch of said second gripping member having a second gripping surface located opposite a compartment wall surface, said first end of said second gripping member is connected to a second housing, said capturing structure is connected to said second housing, whereby, said second housing borders an outer perimeter of said capturing structure, whereby, a portion of said capturing structure protrudes from said second housing;

said second end of said second gripping member is pivotally connected to said fulcrum point, whereby, said second gripping member is located between said capturing structure and said fulcrum point; and, said first gripping surface of said first gripping member and said second gripping surface of said second gripping member are configured to contour to the grasp of a user's hand, whereby, said clothing iron is adapted for the force of a user's grasp to orient said first gripping member and said second gripping member from an open orientation to a closed orientation, whereby, a portion of said garment is configured to be captured between said at least one thermally conductive plate and said capturing structure.

2. The clothing iron configured to operate from a motor vehicle power supply of claim 1, wherein said capturing structure is a thermally conductive plate.

3. The clothing iron configured to operate from a motor vehicle power supply of claim 1, wherein said at least one thermally conductive plate is in electrical connection with at least one heating element.

4. The clothing iron configured to operate from a motor vehicle power supply of claim 3, wherein said at least one heating element is configured to operate on DC voltage supplied by said motor vehicle.

5. The clothing iron configured to operate from a motor vehicle power supply of claim 1, wherein said contouring arch of said first gripping member having at least one dedicated finger recess configured to receive at least one finger of a user.

6. The clothing iron configured to operate from a motor vehicle power supply of claim 1, wherein said contouring arch of said secondary gripping member having a dedicated thumb recess configured to receive a thumb of a user.

7. The clothing iron configured to operate from a motor vehicle power supply of claim 1, wherein said second housing having at least one barrier element connected to an outer perimeter edge of said second housing, said at least one barrier element is located adjacent to a portion of said capturing structure, whereby, said at least one barrier element protrudes from said second housing.

8. The clothing iron configured to operate from a motor vehicle power supply of claim 1, wherein said contouring arch of said second gripping member having at least one dedicated finger recess configured to receive at least one finger of a user.

9. The clothing iron configured to operate from a motor vehicle power supply of claim 1, wherein said at least one thermally conductive plate has at least one opening.

10. The clothing iron configured to operate from a motor vehicle power supply of claim 9, wherein said clothing iron having a spray assembly comprising at least one gripping member having a compartment configured to receive a liquid through a compartment first opening, said compartment having a compartment second opening, said compartment second opening connected to a first end of a tubing, whereby, a second end of said tubing is connected to said at least one opening of said thermally conductive plate, a release mechanism located on said at least one gripping member is configured to be depressed by a user to release said liquid from said compartment.

11. The clothing iron configured to operate from a motor vehicle power supply of claim 10, wherein said compartment first opening having a removable cover.

12. The clothing iron configured to operate from a motor vehicle power supply of claim 1, wherein said clothing iron has an auto shut-off mechanism.

13. The clothing iron configured to operate from a motor vehicle power supply of claim 1, wherein said clothing iron has a port, said port is electrically connected to a removable cigarette lighter plug.

14. The clothing iron configured to operate from a motor vehicle power supply of claim 1, wherein said clothing iron having a port, said port is electrically connected to a removable adapter.

15. The clothing iron configured to operate from a motor vehicle power supply of claim 14, wherein said removable adapter is configured to electrically connect with an AC power source.

16. A clothing iron configured to operate from a motor vehicle power supply, comprising:

at least one thermally conductive plate having a contact surface configured to contact a first side of a garment, said at least one thermally conductive plate is located opposite a capturing structure, whereby, said capturing structure is configured to contact a second side of said garment;

a first gripping member located opposite a second gripping member, said first gripping member comprising a contouring arch extending from a first end of said first gripping member to a second end of said first gripping member, said contouring arch of said first gripping member having a first gripping surface located opposite a compartment wall surface, said first end of said first gripping member is connected to a first housing, said at least one thermally conductive plate is connected to said first housing, whereby, said first housing borders an outer perimeter of said at least one thermally conductive housing, whereby, said contact surface of said at least one thermally conductive plate protrudes from said first housing;

at least one barrier element is connected to an outer perimeter edge of said first housing, said at least one barrier element is located adjacent to a portion of said thermally conductive plate, whereby, said at least one barrier element protrudes from said first housing;

said second end of said first gripping member is pivotally connected to a fulcrum point, whereby, said first gripping member is located between said at least one thermally conductive plate and said fulcrum point;

said second gripping member comprising a contouring arch extending from a first end of said second gripping member to said second end of said second gripping member, said contouring arch of said second gripping member having a second gripping surface located opposite a compartment wall surface, said first end of said second gripping member is connected to a second housing, said capturing structure is connected to said second housing, whereby, said second housing borders an outer perimeter of said capturing structure, whereby, a portion of said capturing structure protrudes from said second housing;

said second end of said second gripping member is pivotally connected to said fulcrum point, whereby, said second gripping member is located between said capturing structure and said fulcrum point;

said first gripping surface of said first gripping member and said second gripping surface of said second gripping member are configured to contour to the grasp of a user's hand, whereby, said clothing iron is adapted for the force of a user's grasp to orient said first gripping member and said second gripping member from an open orientation to a closed orientation, whereby, a portion of said garment is configured to be captured between said at least one thermally conductive plate and said capturing structure;

said contouring arch of said first gripping member having at least one dedicated finger recess configured to receive at least one finger of a user;

said contouring arch of said secondary gripping member having a dedicated thumb recess configured to receive a thumb of a user;

said at least one thermally conductive plate is in electrical connection with at least one heating element; and, a port, said port is electrically connected to a removable cigarette lighter plug.

17. A clothing iron configured to operate from a motor vehicle power supply, comprising:

at least one thermally conductive plate having a contact surface configured to contact a first side of a garment, said at least one thermally conductive plate is located opposite a capturing structure, whereby, said capturing structure is configured to contact a second side of said garment;

a first gripping member located opposite a second gripping member, said first gripping member comprising a contouring arch extending from a first end of said first gripping member to a second end of said first gripping member, said contouring arch of said first gripping member having a first gripping surface located opposite a compartment wall surface, said first end of said first gripping member is connected to a first housing, said at least one thermally conductive plate is connected to said first housing, whereby, said first housing borders an outer perimeter of said at least one thermally conductive housing, whereby, said contact surface of said at least one thermally conductive plate protrudes from said first housing;

at least one barrier element is connected to an outer perimeter edge of said first housing, said at least one barrier element is located adjacent to a portion of said thermally conductive plate, whereby, said at least one barrier element protrudes from said first housing;

said second end of said first gripping member is pivotally connected to a fulcrum point, whereby, said first gripping member is located between said at least one thermally conductive plate and said fulcrum point;

said second gripping member comprising a contouring arch extending from a first end of said second gripping member to said second end of said second gripping member, said contouring arch of said second gripping member having a second gripping surface located opposite a compartment wall surface, said first end of said second gripping member is connected to a second housing, said capturing structure is connected to said second housing, whereby, said second housing borders an outer perimeter of said capturing structure, whereby, a portion of said capturing structure protrudes from said second housing;

said second end of said second gripping member is pivotally connected to said fulcrum point, whereby, said second gripping member is located between said capturing structure and said fulcrum point;

said first gripping surface of said first gripping member and said second gripping surface of said second gripping member are configured to contour to the grasp of a user's hand, whereby, said clothing iron is adapted for the force of a user's grasp to orient said first gripping member and said second gripping member from an open orientation to a closed orientation, whereby, a portion of said garment is configured to be captured between said at least one thermally conductive plate and said capturing structure;

a port, said port is electrically connected to a removable cigarette lighter plug; and, an integrally formed spray assembly comprising at least one gripping member having a compartment configured to receive a liquid through a compartment first opening, said compartment having a compartment second opening, said compartment second opening connected to a first end of a tubing, whereby, a second end of said tubing is connected to said at least one opening of said thermally conductive plate, a release mechanism located on said at least one gripping member is configured to be depressed by a user to release said liquid from said compartment.

18. The clothing iron configured to operate from a motor vehicle power supply of claim 17, wherein said clothing iron having a port, said port is electrically connected to a removable adapter.

19. The clothing iron configured to operate from a motor vehicle power supply of claim 18, wherein said removable adapter is configured to electrically connect with an AC power source.

20. The clothing iron configured to operate from a motor vehicle power supply of claim 17, wherein said at least one thermally conductive plate is in electrical connection with at least one heating element, said at least one heating element is configured to operate on DC voltage supplied by said motor vehicle.

* * * * *